US012698148B2

(12) United States Patent
Zeng

(10) Patent No.: US 12,698,148 B2
(45) Date of Patent: Aug. 4, 2026

(54) AEROSOL TANK VALVE JOINT DEVICE AND AEROSOL TANK

(71) Applicant: DONGGUAN TYRESEALANT AUTO TECH CO., LTD., Dongguan (CN)

(72) Inventor: Yonghua Zeng, Dongguan (CN)

(73) Assignee: DONGGUAN TYRESEALANT AUTO TECH CO., LTD., Dongguan (CN)

( * ) Notice: Subject to any disclaimer, the term of this patent is extended or adjusted under 35 U.S.C. 154(b) by 197 days.

(21) Appl. No.: 18/844,990

(22) PCT Filed: Mar. 22, 2022

(86) PCT No.: PCT/CN2022/082311
§ 371 (c)(1),
(2) Date: May 12, 2025

(87) PCT Pub. No.: WO2023/168756
PCT Pub. Date: Sep. 14, 2023

(65) Prior Publication Data

US 2025/0333235 A1 Oct. 30, 2025

(30) Foreign Application Priority Data

Mar. 8, 2022 (CN) ..... 202220511888.5

(51) Int. Cl.
*B65D 83/16* (2006.01)
*B65D 83/14* (2006.01)
(Continued)

(52) U.S. Cl.
CPC ..... *B65D 83/164* (2025.01); *B65D 83/20* (2013.01); *B65D 83/22* (2013.01); *B65D 83/756* (2013.01)

(58) Field of Classification Search
CPC ..... B65D 83/164; B65D 83/20; B65D 83/22; B65D 83/756
(Continued)

(56) References Cited

U.S. PATENT DOCUMENTS 6,260,739 B1 7/2001 Hsiao
6,708,849 B1 * 3/2004 Carter ..... B65D 83/40 222/530
(Continued)

FOREIGN PATENT DOCUMENTS

CN 205345796 U 6/2016
CN 209734686 U 12/2019
(Continued)

*Primary Examiner* — John Bastianelli

(57) ABSTRACT

An aerosol tank valve joint device and an aerosol tank. The aerosol tank valve joint device comprises a base, a knob, an elastic arm, and a joint. The elastic arm is provided on the base, the joint is provided on the elastic arm, the knob is axially positioned and is rotatably provided on the base in the circumferential direction, and an abutting block is provided on the side of the knob close to the joint. When the knob rotates in the circumferential direction, the abutting block can be driven to be close to and push the joint, or the abutting block can be driven to be away from the joint, such that the joint is reset under the elastic force effect of the elastic arm. The aerosol tank valve joint device of the present application can avoid leakage caused by mistaken touch of the valve during assembly, and has the advantages of being simple in structure and easy to assemble.

8 Claims, 8 Drawing Sheets

(51) Int. Cl.
*B65D 83/20* (2006.01)
*B65D 83/22* (2006.01)

(58) Field of Classification Search
USPC ..... 251/144
See application file for complete search history.

(56) References Cited

U.S. PATENT DOCUMENTS

| | | | | |
|---|---|---|---|---|
| D833,277 | S * | 11/2018 | Kuntzelman | D9/448 |
| 10,150,266 | B2 * | 12/2018 | Marini | B29C 73/166 |
| D915,885 | S * | 4/2021 | Costle | D9/448 |
| 11,242,190 | B2 * | 2/2022 | Costle | B65D 83/22 |
| 2004/0099696 | A1 * | 5/2004 | Stratemeier | B65D 83/7535 222/402.1 |
| 2018/0037400 | A1 | 2/2018 | Kuntzelman | |
| 2020/0299054 | A1 | 9/2020 | Costle et al. | |

FOREIGN PATENT DOCUMENTS

| | | |
|---|---|---|
| CN | 213017935 U | 4/2021 |
| CN | 214058613 U | 8/2021 |

* cited by examiner

AEROSOL TANK VALVE JOINT DEVICE AND AEROSOL TANK

TECHNICAL FIELD

This invention generally relates to the technical field of aerosol tanks, and more particularly, to an aerosol tank valve joint device and an aerosol tank.

BACKGROUND

A tire repairing liquid is a liquid used to fill holes in a tire such that the tire is protected against deflation, which is normally stored under high pressure in an aerosol tank. When repairing, after the mouth of the aerosol tank is in communication with an inflation inlet of the tire, a joint of the tank is controlled to turn on the valve of the tank body, so that the tire repairing liquid at high pressure in the tank is sprayed into the tire through the joint, pipe and spraying mouth, thereby completing the tire repairing process.

Conventional aerosol tanks normally comprise a tank body, a base, a knob and a joint, wherein the valve is arranged on the tank body, the base is arranged on the tank body, and the knob is circumferentially rotatable and axially movably arranged on the base. By rotating the knob, the knob is propelled to move along the axial direction to push the joint, thereby enabling the joint to be in communication with the valve. However, the design of conventional knob has following shortcomings: specifically, the outer side of the knob is provided with a spiral guide groove, the inner side of the base is provided with a protruding guide block, and the guide block interacts with the guide groove during use; in assembly, the knob needs to be mounted on the base, and due to the blocking of the guide block, a large pressure is required to press the knob into the base; however, it cannot be ensured that the same force is imposed every time, and therefore, if the knob is displaced due to the excessively large force, the knob is pressed against the valve, resulting in mistaken touch and accidental turning-on of the value; thus, the leakage of the tire repairing liquid occurs, and the assembly becomes more inconvenient.

SUMMARY

The purpose of the present invention is to provide an aerosol tank valve joint device capable of being conveniently assembled while avoiding leakage caused by mistaken touch of the valve during assembly.

Another purpose of the present invention is to provide an aerosol tank capable of being conveniently assembled while avoiding leakage caused by mistaken touch of the valve during assembly.

To achieve the above purpose, the present invention adopts the following technical solution: an aerosol tank valve joint device comprises a base, a knob, an elastic arm, and a joint; the elastic arm is provided on the base, the joint is provided on the elastic arm, the knob is axially positioned and is rotatably provided on the base in the circumferential direction, and an abutting block is provided on the side of the knob close to the joint; when the knob rotates in the circumferential direction, the abutting block is propelled to be close to and push the joint, or the abutting block is propelled to be away from the joint, such that the joint is reset under the elastic force effect of the elastic arm.

Compared with the prior art, in the present invention, the knob is axially positioned and rotatably arranged on the base in the circumferential direction, and the abutting block is arranged on the knob; when the knob is rotated in the circumferential direction, the abutting block is propelled to move to be close to the joint, thereby pushing the joint such that the joint is communicated with the valve of the aerosol tank; alternatively, the abutting block is propelled to be away from the joint, so that the joint is disconnected from the valve of the aerosol tank; the knob of the present invention is capable of connecting or disconnecting the joint and the valve without axial movement, which significantly simplifies the axial guide mechanism, makes the structure simpler and achieves convenient assembly.

In another preferred embodiment of the present invention, at least one of the abutting block and the joint is provided with an abutting slope, and the abutting block and the joint are in contact with each other through the abutting slope. Through the arrangement of the abutting slope, the abutting block stably and smoothly abuts against the joint.

In another preferred embodiment of the present invention, the inner wall of the mounting hole of the base is provided with an annular step surface. The bottom end of the knob is provided with an elastic engaging portion, and the engaging portion is engaged with the step surface. When the knob is assembled inside the base, the engaging portion elastically deforms inward, allowing the knob to be easily and conveniently installed in the base. The step surface is positioned by the engaging portion, so that the knob is prevented from being accidentally separated from the base and the stability of the structure is ensured.

In another preferred embodiment of the present invention, an inner wall of the base extends inwards to form a positioning portion, a bottom end of the knob is provided with a bearing surface, and the bearing surface abuts against an upper surface of the positioning portion. By means of the interaction between the positioning portion and the bearing surface, the depth of the knob inserted into the base is effectively limited, thereby preventing the knob from being excessively inserted into the base. Thus, the valve is protected from being accidentally turned on, and leakage during the installation is avoided.

In another preferred embodiment of the present invention, an inner wall of the base extends inwards to form a positioning portion, a bottom end of the knob is provided with a limiting portion. After the knob is rotated by a certain angle, the limiting portion is limited by the positioning portion in the circumferential direction. By means of the interaction between the positioning portion and the limiting portion, the knob is prevented from being excessively rotated. Thus, the accuracy of controlling the turning-on and turning-off of the valve is significantly improved.

In another preferred embodiment of the present invention, the middle surface of the base extends upwards to form an annular first wall body, and a mounting hole penetrating through two sides of the base is formed in the middle portion of the first wall body. The first wall body is provided with an opening communicating with the mounting hole, and the knob and the joint are arranged in the mounting hole. A pipe of the joint is led out outwards through the opening.

In another preferred embodiment of the present invention, one side of the knob is provided with a positioning block able to be removed but unable to be restored, and the positioning block is located in the opening. By means of the positioning block, the aerosol tank achieves an anti-counterfeiting or unused identification before being sold and used, thereby ensuring the reliability of the product.

In another preferred embodiment of the present invention, an outer peripheral surface of the base extends upwards to form a second wall body, and the height of the second wall body is not lower than the highest point of the knob. The second wall body surrounds the knob to prevent an external force from accidentally propelling the knob to rotate. Thus, the leakage is avoided, and the use safety is ensured.

In another preferred embodiment of the present invention, an accommodating cavity is formed between the second wall body and the first wall body, and the pipe is accommodated in the accommodating cavity. Thus, the structure of the entire aerosol tank valve joint device becomes more compact, and convenient use and storage are achieved.

An aerosol tank comprises a tank body and an aerosol tank valve joint device, wherein the tank body is provided with a valve, the base is arranged on the tank body, and the joint is in communication with the valve.

DETAILED DESCRIPTION

Figure 1:
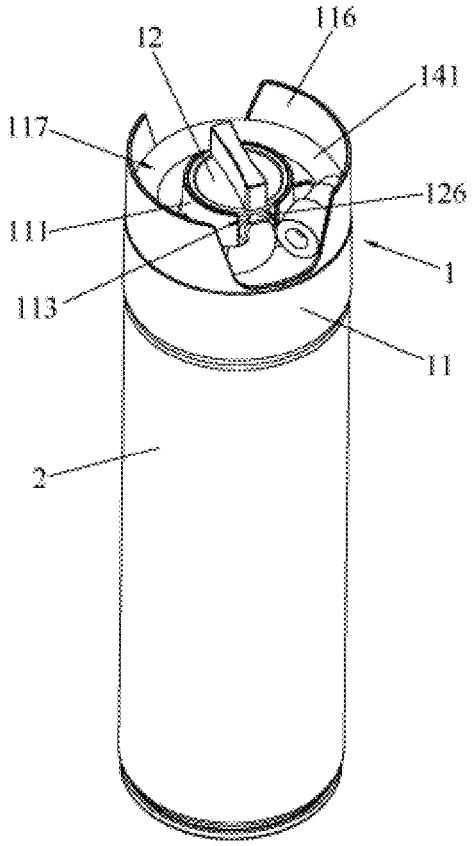
FIG. 1 is a schematic diagram illustrating a three-dimensional structure of the aerosol tank of the present invention.
Figure 2:
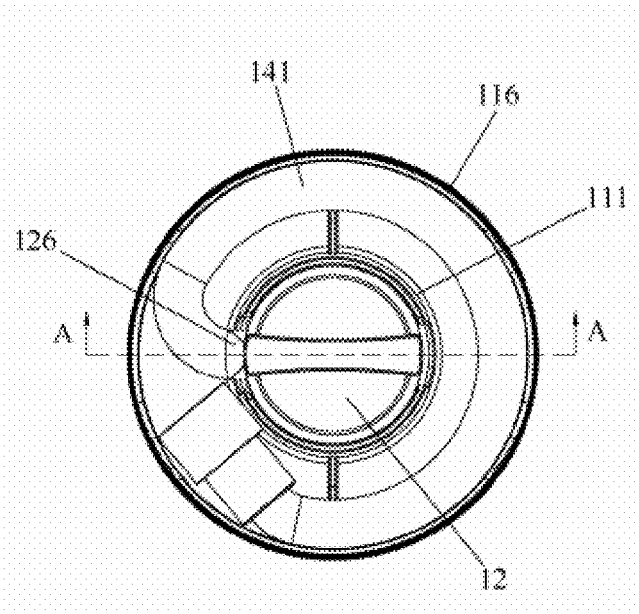
FIG. 2 is a schematic diagram illustrating a top view of the aerosol tank of the present invention.
Figure 3:
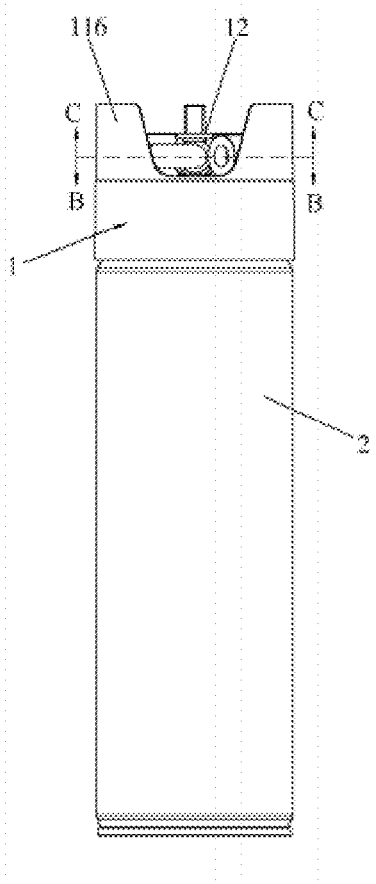
FIG. 3 is a schematic diagram illustrating a side view of the aerosol tank of the present invention.

To describe the technical solutions, structural features and achieved effects of the present invention in detail, embodiments and drawings are combined hereinafter to further elaborate the present invention.

Referring to FIGS. 1-6, the aerosol tank 100 for storing a tire repairing liquid of the present invention comprises a tank body 2 and an aerosol tank valve joint device 1, wherein the aerosol tank valve joint device 1 further comprises a base 11, a knob 12, an elastic arm 13 and a joint 14. A valve 21 communicated with the interior of the tank body 2 is arranged on the top of the tank body 2, and the valve 21 is in a normally closed state. The valve 21 may be turned on by pressing the head of the valve, and the tire repairing liquid in the tank body 2 may be sprayed out through the valve 21. The base 11 is detachably arranged on the tank body 2 by using a fastener. The middle surface of the base 11 extends upwards to form an annular first wall body 111, and a mounting hole 112 penetrating through two sides of the base 11 is formed in the middle portion of the first wall body 111. The first wall body 111 is provided with an opening 113 communicating with the mounting hole 112, and the knob 12 and the joint 14 are arranged in the mounting hole 112. The joint 14 is connected to a flexible pipe 141, and the pipe 141 is led out outwards through the opening 113.

Referring to FIGS. 5-11, the joint 14 is arranged above the valve 21 and is in communication with the valve 21. The elastic arm 13 is arranged on an inner wall of the mounting hole 112 of the base 11, the elastic arm 13 is configured to be a U-shaped structure, and the joint 14 is fixedly arranged on the elastic arm 13. A central axis of the knob 12 is coaxial with a central axis of the tank body 2, and the knob 12 is axially positioned and rotatably arranged in the mounting hole 112 of the base 11 in the circumferential direction. A side surface of the knob 12 close to the joint 14 is provided with an abutting block 121, and at least one of the abutting block 121 and the joint 14 is provided with an abutting slope 122. The abutting block 121 and the joint 14 are in contact with each other through the abutting slope 122. In this embodiment, the abutting block 121 is provided with the abutting slope 122. One end of the joint 14 is provided with a contact block 142, and the abutting slope 122 of the abutting block 121 may abut against the contact block 142 to press against the joint 14. By arranging the abutting slope 122, when the abutting block 121 abuts against the joint 14, the abutting slope 122 is capable of forcing the joint 14 and the elastic arm 13 to press downwards, so that the sliding contact between the abutting block 121 and the joint 14 becomes stably and smoothly. Therefore, when the knob 12 rotates forwardly in the circumferential direction, the abutting block 121 is propelled to be close to and push the joint 14, and the joint 14 is capable of pressing the valve 21 such that the valve 21 is turned on. Alternatively, when the knob 12 rotates reversely in the circumferential direction, the abutting block 121 is propelled to be away from the joint 14, so that the joint 14 is reset under the elastic force of the elastic arm 13. Thus, the joint 14 is away from the valve 21 and the valve 21 is turned off.

Figure 9:
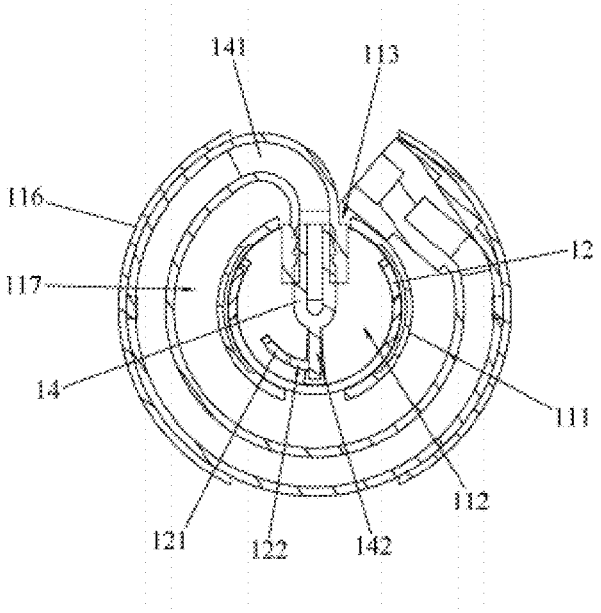
FIG. 9 is a schematic diagram illustrating a sectional view along line C-C in FIG. 3.
Figure 10:
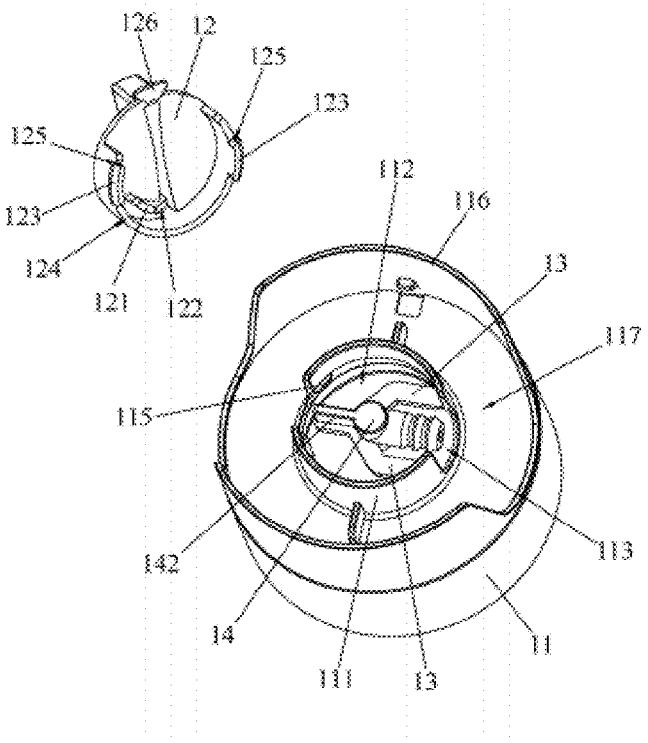
FIG. 10 is a schematic diagram illustrating an exemplary structure of the knob and the base of the aerosol tank the present invention.
Figure 11:
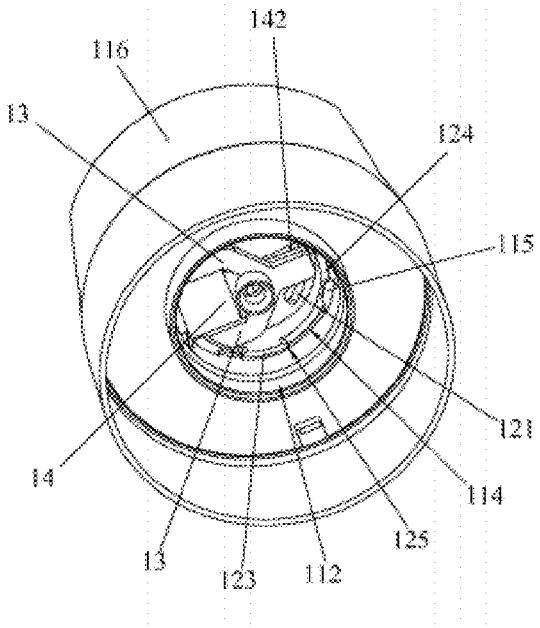
FIG. 11 is a schematic diagram illustrating the interaction between the knob and the base of the aerosol tank the present invention.
Figure 12:
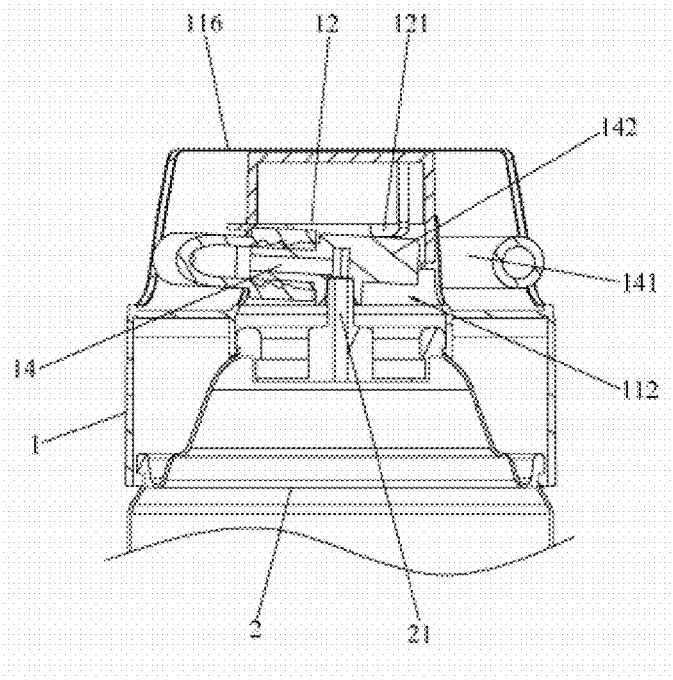
FIG. 12 is a schematic diagram illustrating a sectional view when the knob is pressed against the joint of the aerosol tank of the present invention.

Referring to FIGS. 9, 10 and 11, the inner wall of the mounting hole 112 of the base 11 is provided with an annular step surface 114. More specifically, the diameter of the upper section of the mounting hole 112 is lower than the diameter of the lower section of the mounting hole 112, and the step surface 114 is formed between the upper section of the mounting hole 112 and the lower section of the mounting hole 112. The bottom end of the knob 12 is provided with an elastic engaging portion 123, and the number of the engaging portions 123 is two. The engaging portion 123 extends outward to protrude from an outer side wall of the knob 12, and when the knob 12 is mounted in the mounting hole 112, the engaging portion 123 is engaged with the step surface 114. More specifically, when the knob 12 is assembled inside the base 11, the engaging portion 123 elastically deforms inward, allowing the knob 12 to be easily and conveniently installed in the base 11. When the engaging portion 123 reaching the step surface 114, it is elastically reset to be positioned with the step surface 114. This arrangement avoids the rotation of the knob 12 in the circumferential direction from being affected, and meanwhile, the knob 12 is prevented from moving outwards to accidentally disengage from the base 11. Thus, the stability of the entire structure is ensured. A wall surface of the mounting hole 112 of the base 11 extends inwards to form a positioning portion 115, a bottom end of the knob 12 is provided with an annular bearing surface 124, and the bearing surface 124 abuts against an upper surface of the positioning portion 115. By means of the interaction between the positioning portion 115 and the bearing surface 124, the depth of the knob 12 inserted into the base 11 is effectively limited, thereby preventing the knob 12 from being excessively inserted into the base 11. Thus, the valve 21 is protected from being accidentally turned on, and leakage during the installation is avoided. When the bearing surface 124 abuts against the upper surface of the positioning portion 115, the engaging portion 123 is just engaged with the step surface 114, thereby positioning the central axis of the knob 12. A limiting portion 125 is arranged at the bottom end of the knob 12, and the limiting portion 125 is located at one end of the engaging portion 123. After the knob 12 rotates by a certain angle, the end surface of the positioning portion 115 is capable of limiting the limiting portion 125 in the circumferential direction. Specifically, after the knob 12 is rotated by a certain angle to make the abutting block 121 abut against the joint 14, the limiting portion 125 is limited by the positioning portion 115. By means of the interaction between the positioning portion 115 and the limiting portion 125, the knob 12 is prevented from being excessively rotated. Thus, the accuracy of controlling the turning-on and turning-off of the valve 21 is significantly improved.

Figure 5:
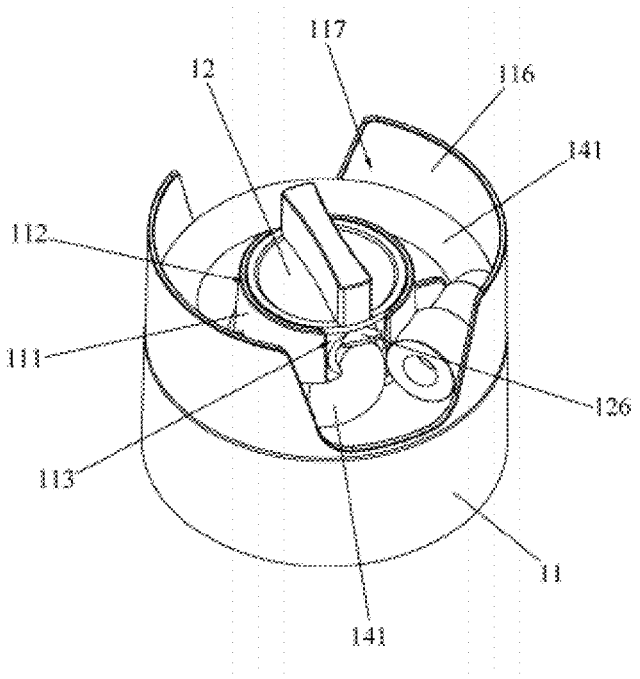
FIG. 5 is a schematic diagram illustrating an exemplary structure of the aerosol tank valve joint device of the present invention.
Figure 6:
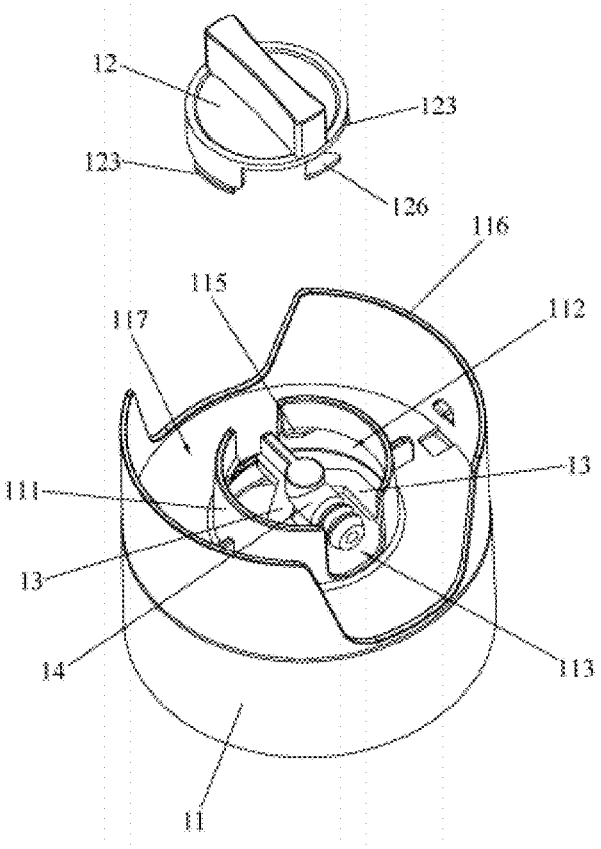
FIG. 6 is a schematic diagram illustrating an explosive view of the aerosol tank valve joint device of the present invention.
Figure 7:
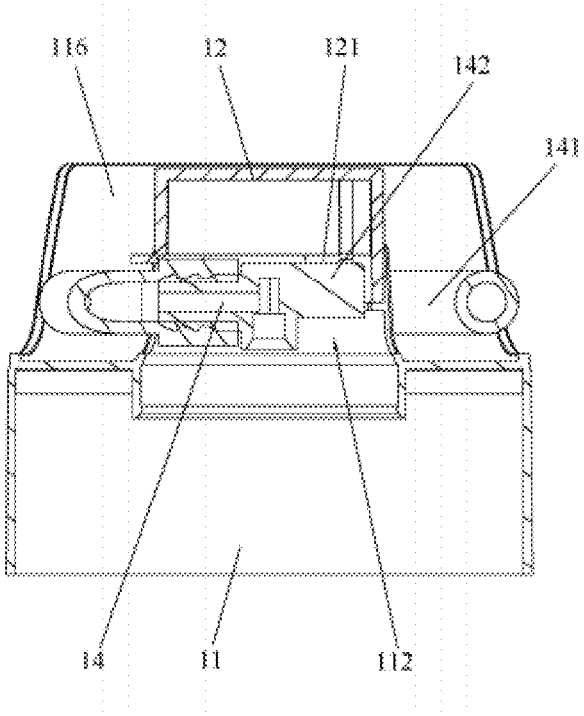
FIG. 7 is a schematic diagram illustrating an explosive view of the aerosol tank valve joint device in FIG. 2.
Figure 8:
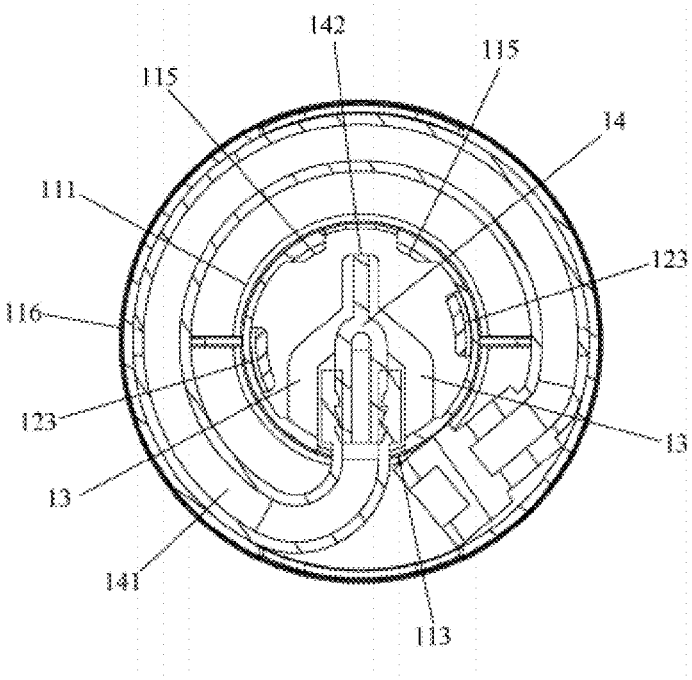
FIG. 8 is a schematic diagram illustrating a sectional view along line B-B in FIG. 3.

Referring to FIGS. 5 and 6, one side of the knob 12 is provided with a positioning block 126 able to be removed but unable to be restored, and the positioning block 126 is located in the opening 113. The positioning block 126 and the knob 12 are integrally formed. When there is a need to rotate the knob 12, the positioning block 126 needs to be broken off first, so that the positioning block 126 is separated from the knob 12. At this point, the knob 12 is capable of being rotated. By means of the positioning block 126, the aerosol tank 100 achieves an anti-counterfeiting or unused identification before being sold and used, thereby ensuring the reliability of the product.

Referring again to FIGS. 5 and 6, an outer peripheral surface of the base 11 extends upwards to form a second wall body 116, and the height of the second wall body 116 is not lower than the highest point of the knob 12. The second wall body 116 is located on the periphery of the first wall body 111, and the second wall body 116 surrounds the knob 12 to prevent an external force from accidentally propelling the knob 12 to rotate. Thus, the leakage is avoided, and the use safety is ensured. There may be a plurality of second wall bodies 116 that jointly surround the knob 12, and a notch is formed between every two adjacent second wall bodies 116. An annular accommodating cavity 117 is formed between the second wall body 116 and the first wall body 111, and the accommodating cavity 117 is communicated with the outside through the notch. The pipe 141 extending out from the joint 14 is capable of extending outwards through the notch, and the pipe 141 may surround the outer side of the first wall body 111 and is further accommodated in the accommodating cavity 117. Thus, the structure of the entire aerosol tank valve joint device 1 becomes more compact, and convenient use and storage are achieved.

Figure 4:
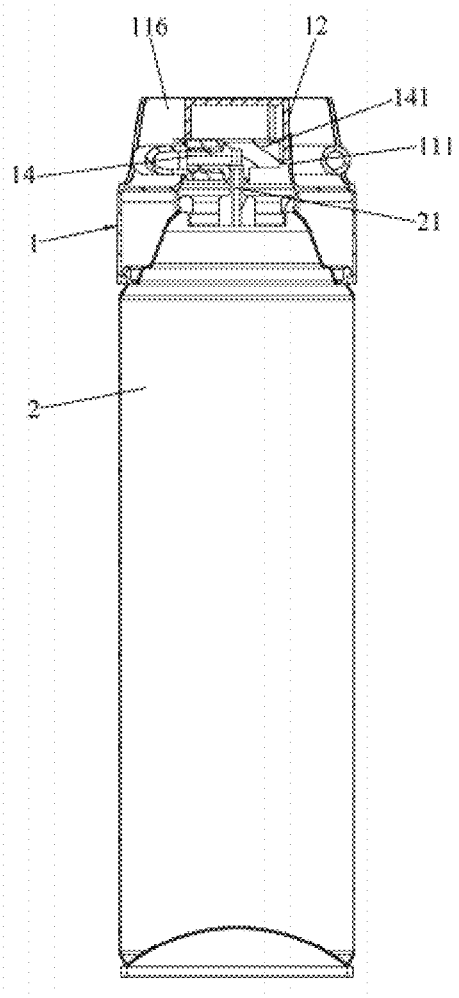
FIG. 4 is a schematic diagram illustrating a sectional view along line A-A in FIG. 2.

Based on the above and combined with FIGS. 4 and 11, the process of using the tire repairing fluid in the aerosol tank 100 of the present invention for tire repair is described in detail as follows: when in use, the pipe 141 is first led out from the accommodating cavity 117, and a connecting portion at one end of the pipe 141 is connected to the inflation inlet of the tire; subsequently, the knob 12 is manually rotated; the knob 12 only rotates in the circumferential direction and does not move axially, and when the knob 12 rotates by a certain angle, the limiting portion 125 is limited by the positioning portion 115; in this process, the knob 12 propels the abutting block 121 to move close to the joint 14 and push the joint 14, and the joint 14 propels the elastic arm 13 to press down to abut against the valve 21; at this point, the valve 21 is turned on, and the tire repairing liquid at high pressure is sprayed out from the valve 21 and enters the tire through the pipe 141, the connecting portion and the inflation inlet of the tire; after that, the hole in the tire is filled with the tire repairing liquid, achieving the effects of tire repair and inflation; when the repairing process is completed, the knob 12 is rotated in the reverse direction; the knob 12 rotates only in the circumferential direction and does not move axially, and the knob 12 is reversely rotated by a certain angle and is then reset; in this process, the knob 12 propels the abutting block 121 to move away from the joint 14, and the joint 14 is away from the valve 21 under the action of the elastic force of the elastic arm 13; at this point, the valve 21 is turned off, and the tire repairing liquid is no longer sprayed out; finally, the pipe 141 is rewound and accommodated in the accommodating cavity 117.

Compared with the prior art, in the present invention, the knob 12 is axially positioned and rotatably arranged on the base 11 in the circumferential direction, and the abutting block 121 is arranged on the knob 12. When the knob 12 is rotated in the circumferential direction, the abutting block 121 is propelled to move to be close to the joint 14, thereby pushing the joint 14 such that the joint 14 is communicated with the valve 21 of the aerosol tank 100. Alternatively, the abutting block 121 is propelled to be away from the joint 14, so that the joint 14 is disconnected from the valve 21 of the aerosol tank 100. The knob 12 of the present invention is capable of connecting or disconnecting the joint 14 and the valve 21 without axial movement, which significantly simplifies the axial guide mechanism, makes the structure simpler and achieves convenient assembly.

The above are merely preferred embodiments of the present invention, and the scope of the present invention is not limited to the embodiments described above. Therefore, equivalent modifications made within the scope of the present invention shall fall into the scope defined by the claims of the present invention.

What is claimed is:

1. An aerosol tank valve joint device, comprising, a base, a knob, an elastic arm, a joint, wherein the elastic arm is provided on the base, wherein the joint is provided on the elastic arm, wherein the knob is axially positioned and is rotatably provided on the base in a circumferential direction, wherein an abutting block is provided on a side of the knob close to the joint, and wherein when the knob rotates in the circumferential direction, the abutting block is propelled to be close to and push the joint, or the abutting block is propelled to be away from the joint, such that the joint is reset under an elastic force effect of the elastic arm a middle surface of the base extends upwards to form an annular first wall body, wherein the mounting hole penetrating through two sides of the base is formed in the middle portion of the first wall body, wherein the first wall body is provided with an opening communicating with the mounting hole, wherein the knob and the joint are arranged in the mounting hole, and wherein a pipe of the joint is led out outwards through the opening, and wherein one side of the knob is provided with a positioning block able to be removed but unable to be restored, and wherein the positioning block is located in the opening.

2. The aerosol tank valve joint device of claim 1, wherein at least one of the abutting block and the joint is provided with an abutting slope, and wherein the abutting block and the joint are in contact with each other through the abutting slope.

3. The aerosol tank valve joint device of claim 1, wherein an inner wall of a mounting hole of the base is provided with an annular step surface, wherein a bottom end of the knob is provided with an elastic engaging portion, and wherein the engaging portion is engaged with the step surface.

4. The aerosol tank valve joint device of claim 1, wherein an inner wall of the base extends inwards to form a positioning portion, wherein the bottom end of the knob is provided is with a bearing surface, and wherein the bearing surface abuts against an upper surface of the positioning portion.

5. The aerosol tank valve joint device of claim 1, wherein the inner wall of the base extends inwards to form the positioning portion, wherein the bottom end of the knob is provided with a limiting portion, and wherein after the knob is rotated by a certain angle, the limiting portion is limited by the positioning portion in the circumferential direction.

6. The aerosol tank valve joint device of claim 1, wherein an outer peripheral surface of the base extends upwards to form a second wall body, and wherein the height of the second wall body is not lower than a highest point of the knob.

7. The aerosol tank valve joint device of claim 6, wherein an accommodating cavity is formed between the second wall body and the first wall body, and wherein the pipe is accommodated in the accommodating cavity.

8. An aerosol tank, comprising:

a tank body, and the aerosol tank valve joint device of claim 1, wherein the tank body is provided with a valve, wherein the base is arranged on the tank body, and wherein the joint is in communication with the valve.

* * * * *